US006534451B1

(12) United States Patent
Watts et al.

(10) Patent No.: US 6,534,451 B1
(45) Date of Patent: Mar. 18, 2003

(54) POWER TRANSMISSION FLUIDS WITH IMPROVED EXTREME PRESSURE LUBRICATION CHARACTERISTICS AND OXIDATION RESISTANCE

(75) Inventors: Raymond F. Watts, Long Valley, NJ (US); Roger K. Nibert, Hampton, NJ (US); Keith R. Gorda, Little York, NJ (US)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 10/117,717

(22) Filed: Apr. 5, 2002

(51) Int. Cl.[7] ..... C10M 14/10; C10M 141/06

(52) U.S. Cl. ..... 508/228; 508/291; 508/442; 508/554

(58) Field of Search ..... 508/228, 291, 508/442, 554

(56) References Cited

U.S. PATENT DOCUMENTS

| | | | | | |
|---|---|---|---|---|---|
| 4,525,289 | A | * | 6/1985 | Howie et al. | 508/428 |
| 5,015,404 | A | * | 5/1991 | Kubo et al. | 508/132 |
| 5,198,133 | A | * | 3/1993 | Papay | 508/188 |
| 5,484,543 | A | * | 1/1996 | Chandler et al. | 508/232 |
| 5,840,663 | A | * | 11/1998 | Nibert et al. | 508/279 |
| 5,942,470 | A | * | 8/1999 | Norman et al. | 508/189 |
| 6,225,266 | B1 | * | 5/2001 | Watts et al | 508/193 |
| 6,337,309 | B1 | * | 1/2002 | Watts et al. | 508/291 |

* cited by examiner

*Primary Examiner*—Jacqueline V. Howard

(57) ABSTRACT

Power transmission fluids exhibiting improved antiwear properties containing a novel antiwear additive formed by reacting elemental sulfur and a dialkyl phosphite in the presence of an acylated amine compound. Also present in the fluid are dispersant, friction modifier, antioxidant and viscosity modifier.

16 Claims, No Drawings

POWER TRANSMISSION FLUIDS WITH IMPROVED EXTREME PRESSURE LUBRICATION CHARACTERISTICS AND OXIDATION RESISTANCE

This invention relates to a composition and a method of improving the extreme pressure lubrication characteristics of a power transmission fluid without sacrificing the oxidation resistance of the fluid.

The continuing quest for improved vehicle fuel economy forces manufacturers to make transmissions smaller, thereby lighter, and utilize them in less ventilated environments. The consequences of these designs are that transmission power throughput is increased, loads on gear surfaces are increased, energy dissipation in the transmission increases while airflow around the transmission decreases due to aerodynamic improvements to the vehicle that reduce convective cooling. Smaller transmissions mean smaller lubricant volumes are required to handle the cooling of the transmission. The net result of these factors is that the demands on the lubricant become very severe. Higher power throughputs, at higher torque levels, increase the needs for excellent extreme pressure characteristics in the lubricant. Reduced cooling with higher transmission energy losses and reduced fluid volume, means higher lubricant temperatures and increased need for oxidation resistance of the fluid and additives.

One solution to this problem is to produce additives with enhanced extreme pressure lubrication characteristics. The problem is more complicated, however, in that in the situation described above oxidation resistance is also a critical aspect of the fluid performance. Therefore, any new extreme pressure agents must also possess excellent oxidation resistance. This has classically presented a problem to lubricant formulators since most extreme pressure agents contain large amounts of sulfur and/or phosphorus; elements that are associated with poor resistance to oxidation.

We have found a class of materials, produced by direct sulfurization of dialkylphosphites followed by neutralization with certain polyamine-containing species, that significantly improve the extreme pressure characteristics of lubricants in which they are used, while having no deleterious effects on the oxidation resistance of the lubricant.

For the purposes of this invention a power transmission fluid is defined as any lubricant used in contact with gears involved in the transmission of mechanical energy. Commonly these devices would include, but not be limited to, automatic transmissions, manual transmissions, continuously variable transmissions, automated manual transmissions, transfer cases, axles and differentials used in mobile applications. They would also include fluids used in conjunction with stationary gearing used in industrial applications and industrial transmissions as well as hydraulic fluids.

In accordance with this invention, there has been discovered a power transmission fluid which exhibits improved antiwear properties comprising a major amount of an oil of lubricating viscosity containing effective amounts of:

(a) an ashless dispersant;

(b) a friction modifier;

(c) an antioxidant;

(d) a viscosity modifier; and (e) an antiwear agent which is the product formed by reacting elemental sulfur and a dialkyl phosphite of the formula $R_1OR_2OPOH$, where $R_1$ and $R_2$ may be alkyl of 1 to 18 carbon atoms, at a temperature of 45–75° C., in the presence of an acylated amine compound selected from the group consisting of:

Structure A

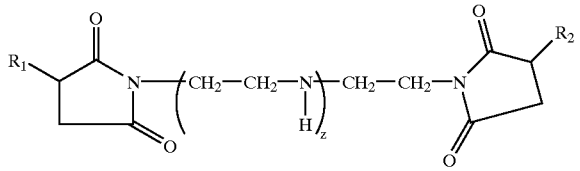

wherein $R_1$ and $R_2$ in Structure A can be the same or different hydrocarbyl group from 4 to 200 carbon atoms, branched or linear alkyl or alkenyl, such as polyisobutenyl, preferably polyisobutenyl of Mn 300–2500 or $C_{12}$–$C_{20}$ alkenyl, and z is an integer from 1 to 8, and Structure B

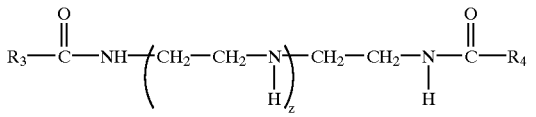

wherein $R_3$ and $R_4$ are the same or different alkyl groups of from 4 to 30 carbon atoms each, branched or linear, and z is an integer from 1 to 8, with the proviso that said antiwear agent provides to the composition 5 to 5000 ppm sulfur and 5 to 5000 ppm phosphorus.

Further embodiments of this invention are the thiophosphite antiwear agent itself and a power transmitting apparatus, such as the devices listed above, containing the fluid of this invention.

Lubricating oils useful in this invention are derived from natural lubricating oils, synthetic lubricating oils, and mixtures thereof. In general, both the natural and synthetic lubricating oil will each have a kinematic viscosity ranging from about 1 to about 100 $mm^2/s$ (cSt) at 100° C., although typical applications will require the lubricating oil or lubricating oil mixture to have a viscosity ranging from about 2 to about 8 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlorodiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Typically the mineral oils will have Kinematic viscosities of from 2.0 $mm^2/s$ (cSt) to 8.0 $mm^2/s$ (cSt) at 100° C. The preferred mineral oils have Kinematic viscosities of from 2 to 6 $mm^2/s$ (cSt), and most preferred are those mineral oils with viscosities of 3 to 5 $mm^2/s$ (cSt) at 100° C.

Synthetic lubricating oils include hydrocarbon oils and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly (1-octenes), poly-(1-decenes), etc., and mixtures thereof]; alkylbenzenes [e.g., dodecyl-benzenes, tetradecylbenzenes, dinonyl-benzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of α-olefins, particularly oligomers of 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000 to 1500); and mono- and poly-carboxylic esters thereof (e.g., the acetic acid esters, mixed $C_3$–$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils are adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetrahydrofurans, poly-α-olefins, and the like.

The lubricating oils may be derived from refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art.

Suitable ashless dispersants for use in this invention include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Also useful are condensation products of polyamines and hydrocarbyl substituted phenyl acids. Mixtures of these dispersants can also be used.

Basic nitrogen containing ashless dispersants are well known lubricating oil additives, and methods for their preparation are extensively described in the patent literature. For example, hydrocarbyl-substituted succinimides and succinamides and methods for their preparation are described, for example, in U.S. Pat. Nos. 3,018,247; 3,018,250; 3,018,291; 3,361,673 and 4,234,435. Mixed ester-amides of hydrocarbyl-substituted succinic acids are described, for example, in U.S. Pat. Nos. 3,576,743; 4,234,435 and 4,873,009. Mannich dispersants, which are condensation products of hydrocarbyl-substituted phenols, formaldehyde and polyamines are described, for example, in U.S. Pat. Nos. 3,368,972; 3,413,347; 3,539,633; 3,697,574; 3,725,277; 3,725,480; 3,726,882; 3,798,247; 3,803,039; 3,985,802; 4,231,759 and 4,142,980. Amine dispersants and methods for their production from high molecular weight aliphatic or alicyclic halides and amines are described, for example, in U.S. Pat. Nos. 3,275,554; 3,438,757 and 3,565,804.

The preferred dispersants are the alkenyl succinimides and succinamides. The succinimide or succinamide dispersants can be formed from amines containing basic nitrogen and additionally one or more hydroxy groups. Usually, the amines are polyamines such as polyalkylene polyamines, hydroxy-substituted polyamines and polyoxyalkylene polyamines. Examples of polyalkylene polyamines include diethylene triamine, triethylene tetramine, tetraethylene pentamine, pentaethylene hexamine. Low cost poly (ethyleneamines) (PAM's) averaging about 5 to 7 nitrogen atoms per molecule are available commercially under trade names such as "Polyamine H", "Polyamine 400", Dow Polyamine E-100", etc. Hydroxy-substituted amines include N-hydroxyalkyl-alkylene polyamines such as N-(2-hydroxyethyl)ethylene diamine, N-(2-hydroxyethyl) piperazine, and N-hydroxyalkylated alkylene diamines of the type described in U.S. Pat. No. 4,873,009. Polyoxyalkylene polyamines typically include polyoxyethylene and polyoxypropylene diamines and triamines having average molecular weights in the range of 200 to 2500. Products of this type are available under the Jeffamine trademark.

The amine is readily reacted with the selected hydrocarbyl-substituted dicarboxylic acid material, e.g., alkylene succinic anhydride, by heating an oil solution containing 5 to 95 wt. % of said hydrocarbyl-substituted dicarboxylic acid material at about 100° to 250° C., preferably 125° to 175° C., generally for 1 to 10, e.g., 2 to 6 hours until the desired amount of water is removed. The heating is preferably carried out to favor formation of imides or mixtures of imides and amides, rather than amides and salts. Reaction ratios of hydrocarbyl-substituted dicarboxylic acid material to equivalents of amine as well as the other nucleophilic reactants described herein can vary considerably, depending on the reactants and type of bonds formed. Generally from 0.1 to 1.0, preferably from about 0.2 to 0.6, e.g., 0.4 to 0.6, equivalents of dicarboxylic acid unit content (e.g., substituted succinic anhydride content) is used per reactive equivalent of nucleophilic reactant, e.g., amine. For example, about 0.8 mole of a pentamine (having two primary amino groups and five reactive equivalents of nitrogen per molecule) is preferably used to convert into a mixture of amides and imides, a composition derived from reaction of polyolefin and maleic anhydride having a functionality of 1.6; i.e., preferably the pentamine is used in an amount sufficient to provide about 0.4 equivalents (that is, 1.6 divided by (0.8×5) equivalents) of succinic anhydride units per reactive nitrogen equivalent of the amine.

Use of alkenyl succinimides which have been treated with a boronating agent are also suitable for use in the compositions of this invention as they are much more compatible with elastomeric seals made from such substances as fluoroelastomers and silicon-containing elastomers. Dispersants may be post-treated with many reagents known to those skilled in the art. (see, e.g., U.S. Pat. Nos. 3,254,025, 3,502,677 and 4,857,214).

The preferred ashless dispersants are polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 300 to 2500 (preferably 400 to 2200). It has been found that selecting certain dispersants within the broad range of alkenyl succinimides produces fluids with improved frictional characteristics. The most preferred dispersants of this invention are those wherein the polyisobutene substituent group has a molecular weight of approximately 950 atomic mass units, the basic nitrogen containing moiety is polyamine (PAM) and the dispersant has been post treated with a boronating agent.

The ashless dispersants of the invention can be used in any effective amount. However, they are typically used from about 0.1 to 10.0 mass percent in the finished lubricant, preferably from about 0.5 to 7.0 percent and most preferably from about 2.0 to about 5.0 percent.

Friction modifiers preferably present in the compositions of the current invention are succinimide compounds having the structure II:

Structure II

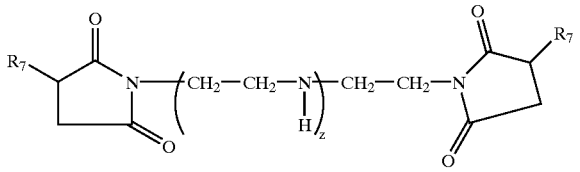

wherein $R_7$ is $C_6$ to $C_{30}$ alkyl, and z=1 to 10.

The alkenyl succinic anhydride starting materials for forming the friction modifiers of structure II can be either of two types. The two types differ in the linkage of the alkyl side chain to the succinic acid moiety. In the first type, the alkyl group is joined through a primary carbon atom in the starting olefin, and therefore the carbon atom adjacent to the succinic acid moiety is a secondary carbon atom. In the second type, the linkage is made through a secondary carbon atom in the starting olefin and these materials accordingly have a branched or isomerized side chain. The carbon atom adjacent to the succinic acid moiety therefore is necessarily a tertiary carbon atom.

The alkenyl succinic anhydrides of the first type, shown as structure III, with linkages through secondary carbon atoms, are prepared simply by heating α-olefins, that is, terminally unsaturated olefins, with maleic anhydride. Examples of these materials would include n-decenyl succinic anhydride, tetradecenyl succinic anhydride, n-octadecenyl succinic anhydride, tetrapropenyl succinic anhydride, etc.

Structure III

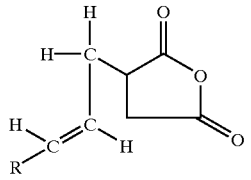

wherein R is $C_3$ to $C_{27}$ alkyl.

The second type of alkenyl succinic anhydrides, with linkage through tertiary carbon atoms, are produced from internally unsaturated olefins and maleic anhydride. Internal olefins are olefins which are not terminally unsaturated, and therefore do not contain the

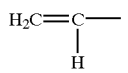

moiety. These internal olefins can be introduced into the reaction mixture as such, or they can be produced in situ by exposing α-olefins to isomerization catalysts at high temperatures. A process for producing such materials is described in U.S. Pat. No. 3,382,172. The isomerized alkenyl substituted succinic anhydrides are compounds having structure IV:

Structure IV

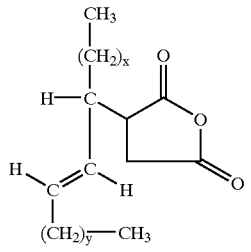

where x and y are independent integers whose sum is from 1 to 30.

The preferred succinic anhydrides are produced from isomerization of linear α-olefins with an acidic catalyst followed by reaction with maleic anhydride. The preferred α-olefins are 1-octene, 1-decene, 1-dodecene, 1-tetradecene, 1-hexadecene, 1 -octadecene, 1-eicosane, or mixtures of these materials. The products described can also be produced from internal olefins of the same carbon numbers, 8 to 20. The preferred materials for this invention are those made from 1-tetradecene (x+y=9), 1-hexadecene (x+y=11) and 1-octadecene (x+y=13), or mixtures thereof.

The alkenyl succinic anhydrides are then further reacted with polyamines having the following structure V:

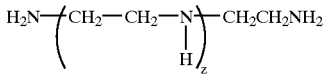

where z is an integer from 1 to 10, preferably from 1 to 3.

The preferred succinimide friction modifiers of this invention are products produced by reacting the isomerized alkenyl succinic anhydride with diethylene triamine, triethylene tetramine, tetraethylene pentamine or mixtures thereof. The most preferred products are prepared using tetraethylene pentamine. The alkenyl succinic anhydrides are typically reacted with the amines in a 2:1 molar ratio so that both primary amines are converted to succinimides. Sometimes a slight excess of isomerized alkenyl succinic anhydride is used to insure that all primary amines have reacted. The products of the reaction are compound of structure II.

The two types of succinimide friction modifiers can be used individually or in combination.

The disuccinimides of structure II may be post-treated or further processed by any number of techniques known in the art. These techniques would include, but are not limited to, boration, maleation, and acid treating with inorganic acids such as phosphoric acid, phosphorous acid, and sulfuric acid. Descriptions of these processes can be found in, for example, U.S. Pat. Nos. 3,254,025; 3,502,677; 4,686,054; and 4,857,214.

Another useful derivative of the succinimide modifiers are where the alkenyl groups of structures II, III and IV have been hydrogenated to form their saturated alkyl analogs. Saturation of the condensation products of olefins and maleic anhydride may be accomplished before or after reaction with the amine. These saturated versions of structures II, III and IV may likewise be post-treated as previously described.

While any effective amount of the compounds of structure II and its derivatives may be used to achieve the benefits of this invention, typically these effective amounts will range from 0.01 to 10 wt. % of the finished fluid, preferably from 0.05 to 7 wt. %, most preferably from 0.1 to 5 wt. %.

The ethoxylated amine friction modifiers of the current invention are compounds having structure VI:

Structure VI

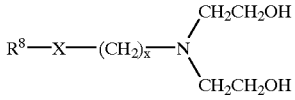

wherein $R_8$ is a $C_6$ to $C_{28}$ alkyl group, X is O, S or $CH_2$, and x=1 to 6.

Alkoxylated amines are a particularly suitable type of friction modifier for use in this invention. Preferred amine compounds contain a combined total of from about 18 to about 30 carbon atoms. In a particularly preferred embodiment, this type of friction modifier is characterized by structure VI where X represents oxygen, $R_8$ contains a total of 18 carbon atoms, and x=3.

Preparation of the amine compounds, when X is oxygen and x is 1, is, for example, by a multi-step process where an alkanol is first reacted, in the presence of a catalyst, with an unsaturated nitrile such as acrylonitrile to form an ether nitrile intermediate. The intermediate is then hydrogenated, preferably in the presence of a conventional hydrogenation catalyst, such as platinum black or Raney nickel, to form an ether amine. The ether amine is then reacted with an alkylene oxide, such as ethylene oxide, in the presence of an alkaline catalyst by a conventional method at a temperature in the range of about 90–150° C.

Another method of preparing the amine compounds, when X is oxygen and x is 1, is to react a fatty acid with ammonia or an alkanol amine, such as ethanolamine, to form an intermediate which can be further oxyalkylated by reaction with an alkylene oxide, such as ethylene oxide or propylene oxide. A process of this type is discussed in, for example, U.S. Pat. No. 4,201,684.

When X is sulfur and x is 1, the amine friction modifying compounds can be formed, for example, by effecting a conventional free radical reaction between a long chain α-olefin with a hydroxyalkyl mercaptan, such as β-hydroxyethyl mercaptan, to produce a long chain alkyl hydroxyalkyl sulfide. The long chain alkyl hydroxyalkyl sulfide is then mixed with thionyl chloride at a low temperature and then heated to about 40° C. to form a long chain alkyl chloroalkyl sulfide. The long chain alkyl chloroalkyl sulfide is then caused to react with a dialkanolamine, such as diethanolamine, and, if desired, with an alkylene oxide, such as ethylene oxide, in the presence of an alkaline catalyst and at a temperature near 100° C. to form the desired amine compounds. Processes of this type are known in the art and are discussed in, for example, U.S. Pat. No. 3,705,139.

In cases when X is oxygen and x is 1, the present amine friction modifiers are well known in the art and are described in, for example, U.S. Pat. Nos. 3,186,946, 4,170,560,4,231,883, 4,409,000 and 3,711,406.

Examples of suitable amine compounds include, but are not limited to, the following: N,N-bis(2-hydroxyethyl)-n-dodecylamine; N,N-bis(2-hydroxyethyl)-1-methyltridecenylamine; N,N-bis(2-hydroxyethyl)-hexadecylamine; N,N-bis(2-hydroxyethyl)-octadecylamine; N,N-bis(2-hydroxyethyl)-octadecenyl-amine; N,N-bis(2-hydroxyethyl)-oleylamine; N-(2-hydroxyethyl)-N-(hydroxy-ethoxyethyl)-n-dodecylamine; N,N-bis(2-hydroxyethyl)-n-dodecyloxyethylamine; N,N-bis(2-hydroxyethyl)-dodecylthioethylamine; N,N-bis(2-hydroxyethyl)-dodecyl-thiopropylamine; N,N-bis(2-hydroxyethyl)-hexadecyloxypropylamine; N,N-bis(2-hydroxyethyl)-hexadecylthiopropylamine; N-2-hydroxyethyl, N-[N',N'-bis(2-hydroxyethyl)ethylamine]-octadecylamine; and N-2-hydroxyethyl, N-[N',N'-bis(2-hydroxy-ethyl)ethylamine]-stearylamine.

The most preferred additive is N,N-bis(2-hydroxyethyl)-hexadecyloxypropylamine which is sold by the Tomah Chemical Co. under the designation E-22-S-2.

The amine compounds may be used as such, however, they may also be used in the form of an adduct or reaction product with a boron compound, such as a boric oxide, a boron halide, a metaborate, boric acid, or a mono-, di-, and trialkyl borate. Such adducts or derivatives may be illustrated, for example, by the following structural formula:

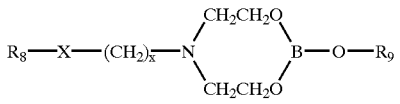

where $R_8$, X, and x are the same as previously defined for structure VI and where $R_9$ is either hydrogen or an alkyl radical.

These ethoxylated amine friction modifiers when used are present in amounts of 0.01 to 1.0 wt. %, preferably 0.05 to 0.75 wt. %, most preferably 0.1 to 0.5 wt. % of the composition.

Other useful friction modifiers for the compositions of this invention are primary amides of long chain carboxylic acids represented by the structure below:

$RCONH_2$ wherein R is preferably an alkenyl or alkyl group having about 12 to 24 carbons, R is most preferably a $C_{17}$ alkenyl group. The preferred primary amide is oleamide. Oleamide is preferably present in an amount between about 0.001 to 0.50 wt. %, based upon the weight percent of the fully formulated oil composition, most preferably present in an amount of 0.1 wt. %.

Suitable antioxidants for use in combination in the compositions of the present invention include amine-type and phenolic antioxidants. Examples of amine-type antioxidants include phenyl alpha naphthylamine, phenyl beta naphthylamine and bis-alkylated diphenyl amines (e.g., p,p'-bis (alkylphenyl)-amines wherein the alkyl groups each contain from 8 to 12 carbon atoms). Phenolic antioxidants include sterically hindered phenols (e.g., 2,6-di-tert-butylphenol, 4-methyl-2,6-di-tert-butylphenol) and bis-phenols (e.g., 4,4"-methylenebis(2,6-di-tert-butylphenol). Another class of useful phenolic anti-oxidants are the derivatives of cinnamic acid and cinnamic acid esters (e.g., the octyl ester of 3,5-dimethyl-4-hydroxyl cinnamic acid). Phosphorous compounds, such as ZDDP, or phosphites are also commonly added to power transmission fluids and passenger car motor oils (PCMO) as antioxidants.

Suitable compounds for use as viscosity modifiers are generally high molecular weight hydrocarbon polymers, including polyesters. Oil soluble viscosity modifying polymers generally have weight average molecular weights from about 10,000 to 1,000,000, preferably from about 20,000 to 500,000, as determined by gel permeation chromatography or light scattering methods.

Representative examples of suitable viscosity modifiers are polyisobutylene, copolymers of ethylene and propylene and higher alpha-olefins, polymethacrylates, polyalkylmethacrylates, methacrylate copolymers, copolymers of unsaturated dicarboxylic acid and vinyl compound, inter polymers of styrene and acrylic esters, and partially hydrogenated copolymers of styrene/isoprene, styrene/butadiene and isoprene/butadiene, as well as partially hydrogenated homopolymers of butadiene and isoprene and isoprene/divinylbenzene.

The anti-wear agents of the present invention are formed by reacting approximately one mole equivalent of sulfur with one mole equivalent of dialkyl phosphite, preferably dibutyl hydrogen phosphite, to produce a monothiophosphite intermediate which is then neutralized with an equivalent amount of primary or secondary amine. Thiophosphites and thiophosphates are well known as anti-wear agents. Normally they are produced by the reaction of alcohols with $P_2S_5$ or $P_4S_{10}$. The resulting adducts are strongly acidic and when used in lubricants tend to be thermally unstable, cause corrosion and interact adversely with elastomeric materials. The products of the current invention overcome these debits in two ways. First, they incorporate only one sulfur atom per phosphorus atom. In this way most of the anti-wear potency of the adduct is obtained while minimizing the undesirable characteristics of the multiple sulfur containing adducts. Second, the acidic product is neutralized with a secondary amine, thereby further reducing its corrosive tendencies and thermal instability. It has been found that using higher molecular weight amines, reaction products of polyamines and acylating agents better thermal and oxidative stability is achieved than when lower molecular weight primary or secondary amines are used.

The thiophosphite products of the current invention can be used in any effective amount. However, they will generally be used at a concentration of between 0.01 and 15.0% in the finished lubricant. Preferably they are used from 0.05 to 10.0% and most preferably from 0.1 to 5.0%. Normally these products will be used at levels in the finished lubricant that yield from 5 to 5000 ppm phosphorus and from 5 to 5000 ppm sulfur. More preferably they will be used at concentrations that yield 25 to 2500 ppm phosphorus and 25 to 2500 ppm sulfur and most preferably from 50 to 1500 ppm of phosphorus and 50 to 1500 ppm of sulfur.

Other additives known in the art may be added to the power transmitting fluids of this invention. These additives include other dispersants, metal detergents, antifoaming agents, seal swellants, pour depressants, antiwear agents, corrosion inhibitors, other extreme pressure additives, and the like. Such additives are disclosed in, for example, "Lubricant Additives" by C. V. Smalheer and R. Kennedy Smith, 1967, pp. 1–11 and U.S. Pat. No. 4,105,571.

The metal detergents which may be used in the compositions of this invention may be oil-soluble neutral or overbased alkali metal, alkaline earth metal (including magnesium) salts of one or more of the following acidic substances (or mixtures thereof): (1) sulfonic acids, (2) carboxylic acids, (3) salicylic acids, (4) alkyl phenols and (5) sulfurized alkyl phenols.

Oil-soluble neutral metal-containing detergents are those detergents that contain stoichiometrically equivalent amounts of metal in relation to the amount of acidic moieties present in the detergent. Thus, in general the neutral detergents will have a low basicity when compared to their overbased counterparts. The acidic materials utilized in forming such detergents include carboxylic acids, salicylic acids, alkylphenols, sulfonic acids, sulfurized alkylphenols and the like.

The term "overbased" in connection with metallic detergents is used to designate metal salts wherein the metal is present in stoichiometrically larger amounts than the organic radical. The commonly employed methods for preparing the overbased salts involve heating a mineral oil solution of an acid with a stoichiometric excess of a metal neutralizing agent such as the metal oxide, hydroxide, carbonate, bicarbonate, of sulfide at a temperature of about 50° C., and filtering the resultant product. The use of a "promoter" in the neutralization step to aid the incorporation of a large excess of metal likewise is known. Examples of compounds useful as the promoter include phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve alcohol, Carbitol alcohol, ethylene glycol, stearyl alcohol, and cyclohexyl alcohol; and amines such as aniline, phenylene diamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60 to 200° C. Overbased detergents have a TBN (total base number, ASTM D-2896) typically of 150 or more such as 250–450.

Examples of suitable metal-containing detergents include, but are not limited to, neutral and overbased salts of such substances as calcium or magnesium phenates, sulfurized magnesium or calcium phenates, wherein each aromatic group has one or more aliphatic groups to impart hydrocarbon solubility; calcium or magnesium sulfonates, wherein each sulfonic acid moiety is attached to an aromatic nucleus which in turn usually contains one or more aliphatic substituents to impart hydrocarbon solubility; calcium or magnesium salicylates wherein the aromatic moiety is usually substituted by one or more aliphatic substituents to impart hydrocarbon solubility, salts of hydrolyzed phosphosulfurized olefins having 10 to 2,000 carbon atoms or of hydrolyzed phosphosulfurized alcohols and/or aliphatic-substituted phenolic compounds having 10 to 2,000 carbon atoms; calcium or magnesium salts of aliphatic carboxylic acids and aliphatic substituted cycloaliphatic carboxylic acids; and many other salts of oil-soluble organic acids. Mixtures of neutral or over-based salts of two or more different alkali and/or alkaline earth metals can be used. Likewise, neutral and/or overbased salts of mixtures of two or more different acids (e.g. one or more overbased calcium phenates with one or more overbased calcium sulfonates) can also be used.

As is well known, overbased metal detergents are generally regarded as containing overbasing quantities of inorganic bases, probably in the form of micro dispersions or colloidal suspensions. Thus the term "oil soluble" as applied to metallic detergents is intended to include metal detergents wherein inorganic bases are present that are not necessarily completely or truly oil-soluble in the strict sense of the term, inasmuch as such detergents when mixed into base oils behave much the same way as if they were fully and totally dissolved in the oil.

Methods for the production of oil-soluble neutral and overbased metallic detergents and alkaline earth metal-containing detergents are well known to those skilled in the art, and extensively reported in the patent literature. See for example, the disclosures of U.S. Pat. Nos. 2,001,108; 2,081,075; 2,095,538; 2,144,078; 2,163,622; 2,270,183; 2,292,205; 2,335,017; 2,399,877; 2,416,281; 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,184,740; 4,212,752; 4,617,135; 4,647,387; 4,880,550.

The metallic detergents utilized in this invention can, if desired, be oil-soluble boronated neutral and/or overbased alkali of alkaline earth metal-containing detergents. Methods for preparing boronated metallic detergents are described in, for example, U.S. Pat. Nos. 3,480,548; 3,679,584; 3,829,381; 3,909,691; 4,965,003; 4,965,004.

Preferred calcium detergents for use with this invention are overbased calcium sulfonates and phenates and overbased sulfurized calcium phenates.

While any effective amount of the metal overbased detergent may be used in this invention, typically effective amounts will be from 0.01 to 5.0 mass percent in the finished fluid. Preferably the treat rate in the fluid will be from 0.05 to 3.0 mass percent, and most preferred is 0.1 to 1.0 mass percent.

Representative amounts of additives in a power transmission fluid are summarized as follows:

| Additive | Broad Wt. % | Preferred Wt. % |
|---|---|---|
| Viscosity Modifiers | 1–12 | 1–4 |
| Corrosion Inhibitor | 0.01–3 | 0.02–1 |
| Dispersants | 0.10–10 | 2–5 |
| Antifoaming Agents | 0.001–5 | 0.001–0.5 |
| Detergents | 0.01–6 | 0.01–3 |
| Antiwear Agents | 0.001–5 | 0.2–3 |
| Pour Point Depressants | 0.01–2 | 0.01–1.5 |
| Seal Swellants | 0.1–8 | 0.5–5 |
| Friction Modifiers | 0.01–5 | 0.01–1.5 |
| Antioxidants | 0.01–5 | 0.01–1.5 |
| Rust Inhibitors | 0.01–10 | 0.01–3 |
| Lubricating Oil | Balance | Balance |

The additive combinations of this invention may be combined with other desired lubricating oil additives to form a concentrate. Typically the active ingredient (a.i.) level of the concentrate will range from 20 to 90 wt. % of the concentrate, preferably from 25 to 80 wt. %, most preferably from 35 to 75 wt. %. The balance of the concentrate is a diluent typically comprised of a lubricating oil or solvent. Such concentrates comprise a further embodiment of this invention.

The following examples are given as specific illustrations of the claimed invention. It should be understood, however, that the invention is not limited to the specific details set forth in the examples. All parts and percentages are by weight unless otherwise specified.

PREPARATIVE EXAMPLES

Example A

A four necked round bottom flask was fitted with an air driven stirrer, a water cooled condenser, thermometer, and nitrogen introduction tube. Into the flask was placed 1 mole (32 gm) of powdered sulfur and one mole of the 2:1 molar reaction product of iso-octadecenyl succinic anhydride and diethylenetriamine (766 gm). The stirrer was started, a nitrogen sweep begun and the mixture heated to 45° C. One mole (202 gm) of dibutyl phosphite was introduced via a dropping funnel, over a 30 minute period. Once addition of the phosphite was complete the mixture was heated to 60° C. and held for 2.5 hours. The mixture was cooled and filtered through Celite. Yield: 996 gm. Elemental analysis of the product: P, 3.1%; S, 3.0%; N, 3.7%.

Example B

The procedure of Example A was repeated except that the following materials and amounts were used: 0.75 mole (24 gm) of powdered sulfur, mole of the 2:1 molar reaction product of iso-octadecenyl succinic anhydride and tetraethylene pentamine in oil (830 gm) and 0.75 mole (151 gm) of dibutyl phosphite. Yield: 1001 gm. Elemental analysis of the product: P, 2.2%; S, 2.0%; N, 5.3%.

Example C

The procedure of Example A was repeated except that the following materials and amounts were used: 0.2 mole (6.6 gm) of powdered sulfur, 0.2 mole of the 2.1:1 molar reaction product of polyisobutenyl succinic anhydride (950 MW polyisobutylene) and polyamine in oil (954 gm) and 0.2 mole (40 gm) of dibutyl phosphite. Yield: 995 gm. Elemental analysis of the product: P, 0.6%; S, 0.7%; N, 1.5%.

Example D

The procedure of Example A was repeated except that the following materials and amounts were used: 0.5 mole (16 gm) of powdered sulfur, 0.5 mole of the 2:1 molar reaction product of polyisobutenyl succinic anhydride (450 MW polyisobutylene) and polyamine in oil (890 gm) and 0.5 mole (101 gm) of dibutyl phosphite. Yield: 1001 gm. Elemental analysis of the product: P, 1.5%; S, 1.5%; N, 3.3%.

Example E

The procedure of Example A was repeated except that the following materials and amounts were used: 0.8 mole (25 gm) of powdered sulfur, 0.8 mole of the 3:1 molar reaction product of iso-stearic acid and tetraethylenepolyamine (820 gm) and 0.8 mole (162 gm) of dibutyl phosphite. Yield: 1002 gm. Elemental analysis of the product: P, 2.4%; S, 2.4%; N, 5.13%.

The following examples are given as specific illustrations of the claimed invention. It should be understood, however, that the invention is not limited to the specific details set forth in the examples. All parts and percentages are by weight unless otherwise specified.

EXAMPLES

Nine test lubricant blends were made for comparison testing. The compositions of the test blends are shown in Table 1.

TABLE 1

| | 1 | 2 | 3 | 4 | 5 | 6 | 7 | 8 | 9 |
|---|---|---|---|---|---|---|---|---|---|
| COMPONENTS MASS % | | | | | | | | | |
| PIBSA-PAM Dispersant (950 MW) | 3.000 | 3.000 | 3.000 | 3.000 | 3.000 | 3.000 | 3.000 | 3.000 | 3.000 |
| Alkylated Diphenyl Amine | 0.250 | 0.250 | 0.250 | 0.250 | 0.250 | 0.250 | 0.250 | 0.250 | 0.250 |
| Dibutyl Hydrogen Phosphite | 0.000 | 0.125 | 0.125 | | | | | | |
| Sulfurized Isobutylene S = 44.0% | | | 0.046 | | | | | | |
| Amine Phosphate | | | | 0.278 | | | | | |
| Product of Example A | | | | | 0.642 | | | | |
| Product of Example B | | | | | | 0.893 | | | |
| Product of Example C | | | | | | | 3.390 | | |
| Product of Example D | | | | | | | | 1.342 | |
| Product of Example E | | | | | | | | | 0.833 |
| 3 cSt diluent oil | 6.750 | 6.625 | 6.579 | 6.472 | 6.108 | 5.857 | 3.360 | 5.408 | 5.917 |
| DI TREAT | 10.000 | 10.000 | 10.000 | 10.000 | 10.000 | 10.000 | 10.000 | 10.000 | 10.000 |
| Exxon 100N Base oil | 90.000 | 90.000 | 90.000 | 90.000 | 90.000 | 90.000 | 90.000 | 90.000 | 90.000 |
| PPM Phosphorus | 0 | 200 | 200 | 200 | 200 | 200 | 200 | 200 | 200 |
| PPM Sulfur | 0 | 0 | 202 | 261 | 195 | 183 | 227 | 199 | 200 |
| FZG | | | | | | | | | |
| STAGE FAIL | 7 | 9 | 13 | 13 | 13 | 12 | 11 | 12 | 13 |
| FOUR BALL WEAR MM | 0.926 | 0.582 | 0.646 | 0.603 | 0.382 | 0.350 | 0.358 | 0.434 | 0.340 |
| 4 BALL EP (ASTM D-2783): | | | | | | | | | |
| Load Wear Index, Kg | 17.5 | 21.3 | 26.1 | 22.9 | 32.8 | 27 | 32.6 | 27. | 32.5 |
| Initial Seizure Load, Kg | 50 | 63 | 80 | 63 | 100 | 80 | 100 | 80 | 100 |
| Weld Point, Kg | 126 | 126 | 126 | 160 | 160 | 160 | 160 | 160 | 160 |

Test blend 1 is a "blank" containing no extreme pressure agents. Test blends 2 through 4 are comparative blends using commonly available extreme pressure agents that are not products of the invention. The sulfurized isobutylene is a commercial material containing about 44% sulfur. The amine phosphate is a common extreme pressure agent the preparation of which is described in U.S. Pat. No. 3,197,405. Blends five through nine contain the products of preparative Examples A through E. All blends are made up to contain 200 ppm phosphorus and consequently have 200 ppm sulfur in the fluid from the additives (excludes basestock contributed sulfur).

Wear Test Results

All nine test blends were run in the FZG gear test according to the ASTM D5182 method. This test measures the ability of a lubricant to protect highly loaded gears against scuffing. Higher load stages are better results. The results of this testing are shown in Table 1. The products of the current invention give results comparable to the best of the conventional additives in by this method. Test repeatability is +/− one load stage with 13 as a maximum. Therefore 13 minus 1 or 12 is the nominal best performance and all fluids except the control fall into this band.

The four ball wear test (ASTM D-4172) was also run on the nine test lubricants. The results of this testing are shown in Table 1. Here a clear advantage is shown for the products of the invention. In this test smaller scar diameters, reported in mm, are desirable. The best of the comparative fluids gave a scar of 0.582, while all the products of the invention gave results below 0.44 mm and as low as 0.35 mm in the case of Fluid 6.

The nine test lubricants were also evaluated by the four ball EP (extreme pressure) test (ASTM D-2783). The results of this testing are shown in Table 1. Better results are higher load wear index, higher initial seizure load and higher weld point. The products of the invention all give better load wear indexes than the best of the comparative materials. The products of the invention also give initial seizure and weld point results equal to the best of the comparative products and better than the combined results of any single comparative product (i.e. comparative blend 3 has the best initial seizure load while comparative blend 4 has the highest weld load).

This data clearly shows the advantage of the products of the invention in wear and extreme pressure performance when compared to conventional additives.

Oxidation Test Results

The nine test fluids were run in the DKA Oxidation procedure according to CEC-L-48-A-97/B for 192 hours at 170° C. The results of this testing are shown in Table 2.

TABLE 2

| | Blend 1 | Blend 2 | Blend 3 | Blend 4 | Blend 5 | Blend 6 | Blend 7 | Blend 8 | Blend 9 |
|---|---|---|---|---|---|---|---|---|---|
| % Increase KV100 | 2.5 | 3.5 | 3.7 | 7.3 | 5.0 | 4.3 | 3.3 | 3.8 | 2.2 |
| ΔTAN (mg KOH/gm) | 0.4 | 1.0 | 1.1 | 1.5 | 0.8 | 1.0 | 0.7 | 0.9 | 0.9 |

Better results in this oxidation test are lower viscosity percent increases and lower increases in total acid number (TAN). Comparative blend 1 is the best case with no extreme pressure additives present. Blend 4 represents typical performance of conventional extreme pressure additives. The results in Table 2 show that the products of the invention generally give viscosity increases equal to or better than the best comparative blends, which exhibit poorer extreme pressure properties and considerably better than a typical conventional additive. The acid number increases for the products of the invention are equal to or better than any of the extreme pressure agent containing comparative blends (Fluids 2 through 4).

The foregoing examples show that the products of this invention when treated at equal phosphorus level to conventional extreme pressure additives give better extreme pressure and wear performance coupled with better overall oxidation performance.

What is claimed is:

1. A power transmission fluid composition which exhibits improved antiwear properties comprising a major amount of an oil of lubricating viscosity containing effective amounts of:

(a) an ashless dispersant;

(b) a friction modifier;

(c) an antioxidant;

(d) a viscosity modifier; and (e) an antiwear agent which is the product formed by reacting elemental sulfur and a dialkyl phosphite of the formula $R_1OR_2OPOH$, where $R_1$ and $R_2$ may be alkyl of 1 to 18 carbon atoms, at a temperature of 45–75° C., in the presence of an acylated amine compound selected from the group consisting of:

Structure A

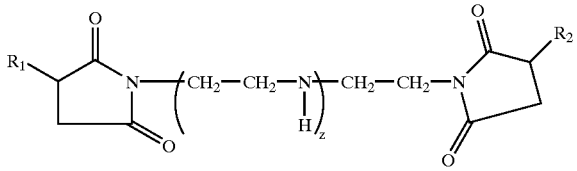

wherein $R_1$ and $R_2$ in Structure A can be the same or different hydrocarbyl group from 4 to 200 carbon atoms, branched or linear and z is an integer from 1 to 8, and Structure B

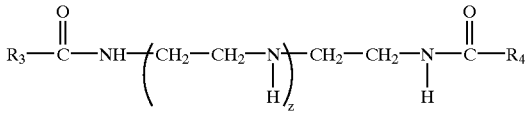

wherein $R_3$ and $R_4$ are the same or different alkyl groups of from 4 to 24 carbon atoms, branched or linear and z is an integer from 1 to 8, with the proviso that said antiwear agent provides to the composition 5 to 5,000 ppm sulfur and 5 to 5,000 ppm phosphorus.

2. The composition of claim 1 wherein $R_1$ and $R_2$ in Structure A may be $C_{12}$–$C_{20}$ alkenyl or polyisobutenyl of Mn 300–1500.

3. The composition of claim 1 further comprising a metallic detergent additive.

4. The composition of claim 1 wherein the dispersant is a polyisobutenyl (Mn 300–2500) succinimide.

5. The composition of claim 1 wherein the antioxidant is a bis-alkylated diphenylamine wherein the alkyl groups each contain 8–12 carbon atoms.

6. The composition of claim 1 wherein the phosphite is dibutyl hydrogen phosphite.

7. A power transmitting apparatus containing the fluid of claim 1 or claim 2.

8. An additive concentrate for preparation of an automatic transmission fluid comprising a lubricating oil or solvent containing 20–90 wt. % of an admixture of:

(a) an ashless dispersant;

(b) a friction modifier;

(c) an antioxidant;

(d) a viscosity modifier; and (e) an antiwear agent which is the product formed by reacting elemental sulfur and a dialkyl phosphite of the formula $R_1OR_2OPOH$, where $R_1$ and $R_2$ may be alkyl of 1 to 18 carbon atoms, at a temperature of 45–75° C., in the presence of an acylated amine compound selected from the group consisting of:

Structure A

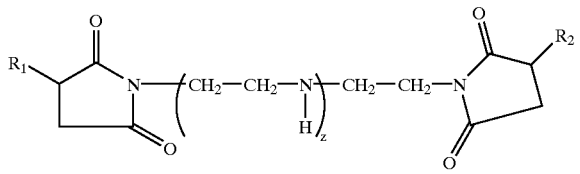

wherein $R_1$ and $R_2$ in Structure A can be the same or different hydrocarbyl group from 4 to 200 carbon atoms, branched or linear and z is an integer from 1 to 8, and Structure B

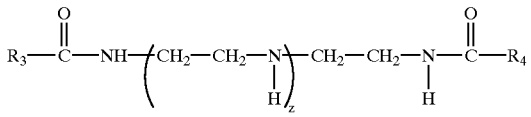

wherein $R_3$ and $R_4$ are the same or different alkyl groups of from 4 to 24 carbon atoms, branched or linear and z is an integer from 1 to 8.

9. The concentrate of claim 8 wherein $R_1$ and $R_2$ in Structure A may be $C_{12}$–$C_{20}$ alkenyl or polyisobutenyl of Mn 300–1500.

10. The concentrate of claim 8 further comprising a metallic detergent additive.

11. The concentrate of claim 8 wherein the dispersant is a polyisobutenyl (Mn 300–2500) succinimide.

12. The concentrate of claim 8 wherein the antioxidant is a bis-alkylated diphenylamine wherein the alkyl groups each contain 8–12 carbon atoms.

13. The concentrate of claim 8 wherein the phosphite is dibutyl hydrogen phosphite.

14. An antiwear agent which is the product formed by reacting elemental sulfur and a dialkyl phosphite of the formula $R_1OR_2OPOH$, where $R_1$ and $R_2$ may be lower alkyl of 1 to 18 carbon atoms, at a temperature of 45–75° C., in the presence of an acylated amine compound selected from the group consisting of:

Structure A

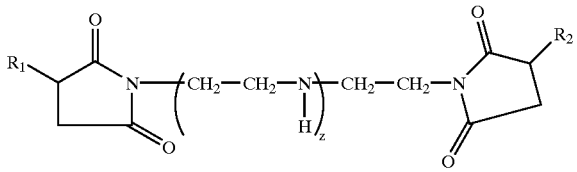

wherein $R_1$ and $R_2$ in Structure A can be the same or different hydrocarbyl group from 4 to 200 carbon atoms, branched or linear and z is an integer from 1 to 8, and Structure B

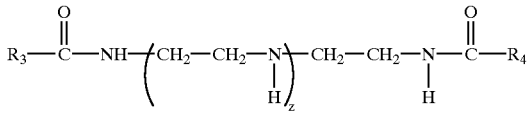

wherein $R_3$ and $R_4$ are the same or different alkyl groups of from 4 to 24 carbon atoms, branched or linear and z is an integer from 1 to 8.

15. The antiwear agent of claim 14 wherein $R_1$ and $R_2$ in Structure A may be $C_{12}$–$C_{20}$ alkenyl or polyisobutenyl of Mn 300–1500.

16. The antiwear agent of claim 14 wherein the phosphite is dibutyl hydrogen phosphite.

* * * * *